US006981392B2

(12) United States Patent
Miyai

(10) Patent No.: US 6,981,392 B2
(45) Date of Patent: Jan. 3, 2006

(54) GLOVES AND METHOD OF KNITTING THE SAME

(75) Inventor: Takuya Miyai, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/525,969

(22) PCT Filed: Aug. 26, 2003

(86) PCT No.: PCT/JP03/10812

§ 371 (c)(1),
(2), (4) Date: Feb. 28, 2005

(87) PCT Pub. No.: WO2004/020719

PCT Pub. Date: Mar. 11, 2004

(65) Prior Publication Data

US 2005/0235701 A1 Oct. 27, 2005

(30) Foreign Application Priority Data

Aug. 28, 2002 (JP) ..... 2002-249288

(51) Int. Cl.
*D04B 7/34* (2006.01)

(52) U.S. Cl. ..... 66/65; 66/174

(58) Field of Classification Search ..... 66/60 R, 66/64, 65, 69, 174; 2/169
See application file for complete search history.

(56) References Cited

U.S. PATENT DOCUMENTS

| | | | | | |
|---|---|---|---|---|---|
| 2,877,635 | A * | 3/1959 | Powell | 66/65 |
| 3,115,760 | A * | 12/1963 | Pierce | 66/65 |
| 3,788,103 | A * | 1/1974 | Asai | 66/65 |
| 3,916,647 | A * | 11/1975 | Yabuta | 66/65 |
| 5,239,846 | A * | 8/1993 | Kitaura et al. | 66/174 |
| 5,987,930 | A * | 11/1999 | Nakai | 66/69 |
| 6,216,494 | B1 * | 4/2001 | Essig et al. | 66/65 |
| 2003/0106344 | A1 | 6/2003 | Okamoto | |

FOREIGN PATENT DOCUMENTS

| | | |
|---|---|---|
| EP | 1 270 782 | 1/2003 |
| EP | 1 283 290 | 2/2003 |
| JP | 31-8521 | 6/1956 |
| JP | 34-3037 | 4/1959 |

(Continued)

*Primary Examiner*—Danny Worrell
(74) *Attorney, Agent, or Firm*—Wenderoth, Lind & Ponack, L.L.P.

(57) ABSTRACT

A method for knitting a glove is provided in which the glove is knitted by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds. The method includes the steps of knitting a four-finger body through which a little finger, a ring finger, a middle finger, and an index finger are to be inserted; performing a rotational operation before joining the four-finger body with a thumb sheath, the rotational operation being performed by transferring stitches of the four-finger body held by knitting needles to free needles and moving at least one of the front and back needles beds in a racking motion so as to rotate the four-finger body towards knitting needles holding stitches of the thumb sheath; and joining the four-finger body with the thumb sheath.

12 Claims, 10 Drawing Sheets

FOREIGN PATENT DOCUMENTS

| | | |
|---|---|---|
| JP | 2091254 | 3/1990 |
| JP | 9-188945 | 7/1997 |
| JP | 10-140446 | 5/1998 |
| JP | 11-124757 | 5/1999 |
| JP | 11-152656 | 6/1999 |
| WO | 02/070800 | 9/2002 |

* cited by examiner

GLOVES AND METHOD OF KNITTING THE SAME

TECHNICAL FIELD

The present invention relates to a glove and a method for knitting the glove by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds.

BACKGROUND ART

Typical gloves, such as working gloves, which include finger sheaths, a four-finger body, and a five-finger body knitted in a continuous manner, are knitted by using a dedicated glove-knitting device. Most of the gloves of these types can be worn on the left or right hand.

Conventional gloves that can be worn on the left or right hand are generally knitted in a manner such that, as shown in FIG. 10, the knitted segments of the glove defined by a little-finger sheath 1, a ring-finger sheath 2, a middle-finger sheath 3, a index-finger sheath 4, a thumb sheath 5, and a five-finger body are in the same plane of a backhand-side and a palm-side of the glove.

In detail, the knitting operation for the glove is performed by first knitting the little-finger sheath 1, and then sequentially knitting the ring-finger sheath 2, the middle-finger sheath 3, and the index-finger sheath 4. The little-finger sheath 1 to the index-finger sheath 4 define a one tubular body so as to form a four-finger body.

After knitting the four-finger body, the thumb sheath 5 is knitted. The thumb sheath 5 and the previously-knitted four-finger body are joined to each other so as to form one five-finger body. Subsequently, a wrist portion is knitted, whereby the entire knitting operation is completed.

When knitting the finger sheaths using, for example, a dedicated glove-knitting device, a restraining rod called a razor is generally used. The razor holds two to three stitches of the previously-knitted sheath proximate the subsequent sheath to be knitted onto the corresponding knitting needles so that the knitting needles holding the stitches are used in the knitting process for the subsequent sheath.

This is performed for each of finger-converging portions among the little-finger sheath 1 to the index-finger sheath 4 by shifting the razor to the corresponding position.

When the knitting processes for all of the sheaths except for the thumb sheath 5 are finished, the stitches previously in an inoperative state are set to an operative state, and a knitting process for the four-finger body is performed by turning a knitting yarn while stitches are overlapped at each finger-converging portion. Such a knitting process for each finger-converging portion is also performed between the four-finger body and the thumb sheath 5.

As mentioned above, the knitting operation for knitting a conventional glove is performed in a manner such that the knitted segments of the glove defined by the little-finger sheath 1, the ring-finger sheath 2, the middle-finger sheath 3, the index-finger sheath 4, the thumb sheath 5, and the five-finger body are in the same plane of a backhand-side and a palm-side of the glove.

However, in the palm of an actual human hand, the base portion of the thumb protrudes from the entire palm, and the thumb is therefore positioned in front of the other fingers.

For this reason, the pointing direction of the thumb-tip and the thumbnail is different from the pointing direction of the fingertips and the fingernails of the little finger, the ring finger, the middle finger, and the index finger.

Consequently, in a flat-knitted glove described above, a feeling of tightness may be generated at the backhand side of the base portion of the thumb when the glove is worn. This causes a bad fit of the glove on the hand, and moreover, leads to a bad appearance of the glove due to stretched stitches at the backhand side.

Furthermore, when the glove is worn, the body portion of the thumb comes into contact with bulging portions Y disposed at opposite sides of a fingertip curve-line X formed at the tip of the thumb sheath 5. This causes a sense of discomfort when the glove is worn and thus leads to deterioration of workability.

DISCLOSURE OF INVENTION

It is an object of the present invention to provide a glove having a three-dimensional structure that properly fits an actual human hand so as to reduce a feeling of tightness when the glove is worn, and to provide a method for knitting such a glove. Moreover, it is another object of the present invention to provide a glove that prevents a sense of discomfort in the thumb when the glove is worn so as to contribute to improvement in workability, and to provide a method for knitting such a glove.

A first aspect according to the present invention provides a method for knitting a glove by using a flat-knitting device including at least a pair of front and back needle beds which extend in a horizontal direction while facing each other from front and back directions at least one of the front and back needle beds being movable horizontally in a racking motion, the flat-knitting device capable of transferring stitches between the front and back needle beds. This method includes the steps of knitting a four-finger body through which a little finger a ring finger a middle finger, and an index finger are to be inserted; performing a first rotational operation and a second rotational operation before joining the four-finger body with a thumb sheath, wherein the first rotational operation is performed by transferring stitches of the four-finger body held by knitting needles to free needles and moving at least one of the front and back needles beds in a racking motion so as to rotate the four-finger body towards knitting needles holding stitches of the thumb sheath, and wherein the second rotational operation is performed by transferring the stitches of the thumb sheath held by the knitting needles to free needles and moving said at least one of the front and back needles beds in a racking motion so as to rotate the thumb sheath within a range of ¼ of a round or less; and joining the four-finger body with the thumb sheath.

According to this method, the joining position between the four-finger body and the thumb sheath can be made more similar to the shape of an actual human hand, and the entire glove is given a three-dimensional structure. This reduces the feeling of tightness at the backhand side of the base portion of the thumb when the glove is worn, and thus contributes to a better fit of the glove on the hand. Further, the rotational operation for the thumb sheath prevents the body portion of a human thumb from being in contact with bulging portions disposed at opposite sides of a fingertip curve-line formed at the tip of the thumb sheath. This prevents a sense of discomfort when the glove is worn and thus contributes to better workability.

The rotational operation for the four-finger body is preferably performed such that the four-finger body is rotated by 1/10 of a round from the state in which the four-finger body and the thumb sheath are not yet joined to each other, that is, the four-finger body is rotated by 1/10 of a round towards the knitting needles holding the stitches of the thumb sheath.

According to this method, the rotational operation for the thumb sheath prevents the body portion of a human thumb from being in contact with bulging portions disposed at opposite sides of a fingertip curve-line formed at the tip of the thumb sheath. This prevents a sense of discomfort when the glove is worn and thus contributes to better workability.

The rotational operation for the thumb sheath is preferably performed such that the thumb sheath is rotated within a range of 3/20 of a round to 1/4 of a round from the state in which the four-finger body and the thumb sheath are not yet joined to each other. The rotating direction corresponds to a direction in which a stitch of the thumb sheath disposed the farthest from the four-finger body rolls toward the palm.

A second aspect according to the present invention provides a method for knitting a glove by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds. This method includes the steps of knitting a four-finger body through which a little finger, a ring finger, a middle finger, and an index finger are to be inserted; performing the rotational operation by transferring the stitches of the thumb sheath held by knitting needles to free needles and moving at least one of the front and back needles beds in a racking motion so as to rotate the thumb sheath within a range of 1/4 of a round or less; overlapping some stitches of a thumb sheath with a predetermined number of stitches on a palm-side of the four-finger body from an end of the four-finger body proximate an index-finger sheath before joining the four-finger body with the thumb sheath; performing a cast-off process on the overlapping stitches; and knitting a five-finger body.

According to this method, the joining position between the four-finger body and the thumb sheath can be made more similar to the shape of an actual human hand, and the entire glove is given a three-dimensional structure. This reduces the feeling of tightness at the backhand side of the base portion of the thumb when the glove is worn, and thus contributes to a better fit of the glove on the hand. Further, the rotational operation for the thumb sheath prevents the body portion of a human thumb from being in contact with bulging portions disposed at opposite sides of a fingertip curve-line formed at the tip of the thumb sheath. This prevents a sense of discomfort when the glove is worn and thus contributes to better workability.

Furthermore, the rotational operation for the thumb sheath is preferably performed such that the thumb sheath is rotated within a range of 3/20 of a round to 1/4 of a round from the state in which the four-finger body and the thumb sheath are not yet joined to each other. The rotating direction corresponds to a direction in which a stitch of the thumb sheath disposed the farthest from the four-finger body rolls toward the palm.

A third aspect according to the present invention provides a method for knitting a glove by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds. This method includes the steps of knitting a four-finger body through which a little finger, a ring finger, a middle finger, and an index finger are to be inserted; knitting a thumb sheath; joining the four-finger body with the thumb sheath; and knitting a five-finger body such that a palm-side fabric-segment of the five-finger body has a less number of stitches than a backhand-side fabric-segment of the five-finger body, whereby the thumb sheath protrudes outward from the palm-side fabric-segment of the five-finger body and is disposed in a rotating manner with respect to the palm-side fabric-segment.

According to this method, by simply reducing the knitting width of the palm-side fabric-segment of the five-finger body, the glove is given a structure in which the thumb sheath protrudes from the palm-side of the four-finger body. This achieves a three-dimensional structure of the glove that properly fits an actual human hand. Accordingly, this reduces the feeling of tightness at the backhand side of the base portion of the thumb when the glove is worn, and thus contributes to a better fit of the glove on the hand.

Furthermore, the five-finger body is preferably knitted while an overlapping process is performed on the palm-side fabric-segment of the five-finger body for a predetermined number of courses, the overlapping process being performed from a side of the palm-side fabric-segment proximate the thumb sheath and by overlapping stitches of the five-finger body extending continuously from stitches of the four-finger body in the wale direction with stitches of the five-finger body extending continuously from stitches of the thumb sheath in the wale direction.

According to this method, even if a decrease-stitch line may appear in the inner portion of the palm, the decrease-stitch line will be disposed along a valley line formed at the base portion of the thumb sheath. Consequently, this contributes to a good appearance of the glove.

Furthermore, in one of the above aspects, before joining the four-finger body with the thumb sheath, the four-finger body may be knitted in a manner such that a knitting width of the four-finger body is increased by increasing stitches at a section of the four-finger body proximate the thumb sheath.

According to this method, since the dimension of the four-finger body in the width direction of the glove can be increased, the feeling of tightness at the backhand side of the base portion of the thumb is further reduced when the glove is worn, and moreover, a bad appearance of the glove due to stretched stitches is prevented.

Furthermore, after the four-finger body is joined with the thumb sheath, the five-finger body may be knitted in a manner such that a knitting width of the five-finger body is reduced.

According to this method, a shape more similar to that of a human hand can be achieved, and moreover, the wrist portion is prevented from becoming loose even if the knitting width of the four-finger body is increased.

Furthermore, the five-finger body is preferably knitted while the stitches of the five-finger body extending continuously from the stitches of the thumb sheath in the wale direction are overlapped with the stitches of the five-finger body extending continuously from the stitches of the four-finger body in the wale direction for a predetermined number of courses.

According to this method, even if a decrease-stitch line may appear in the inner portion of the palm, the decrease-stitch line will be disposed along a valley line formed at the base portion of the thumb sheath. Consequently, this contributes to a good appearance of the glove.

A fourth aspect according to the present invention provides a glove knitted by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds. The glove includes a four-finger body through which a little finger, a ring finger, a middle finger, and an index finger are to be inserted; and a thumb sheath. The four-finger body is joined with the thumb sheath such that a joining position between the four-finger body and the thumb sheath is disposed on a palm-side of the four-finger body at a section between an end of the four-finger body proximate an index-finger sheath and a center of a palm, wherein the thumb sheath is joined with the four-finger body such that the thumb sheath is rotated within a range of ¼ of a round or less.

A fifth aspect according to the present invention provides a glove knitted by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds. The glove includes a four-finger body through which a little finger, a ring finger, a middle finger, and an index finger are to be inserted; and a thumb sheath. Some stitches of the thumb sheath are overlapped with a predetermined number of stitches on a palm-side of the four-finger body from an end of the four-finger body proximate an index-finger sheath in a state such that the thumb sheath is rotated within a range of ¼ of a round or less, the overlapping stitches being cast off.

A sixth aspect according to the present invention provides a glove knitted by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds. The glove includes a four-finger body through which a little finger, a ring finger, a middle finger, and an index finger are to be inserted; and a thumb sheath. After the four-finger body is joined with the thumb sheath, a five-finger body is formed such that a palm-side fabric-segment of the five-finger body has a less number of stitches than a backhand-side fabric-segment of the five-finger body, whereby the thumb sheath protrudes outward from the palm-side fabric-segment of the five-finger body and is disposed in a rotating manner with respect to the palm-side fabric-segment.

In the glove according to each of the above aspects, the joining position between the four-finger body of the glove and the thumb sheath can be made more similar to the shape of an actual human hand, and the entire glove is given a three-dimensional structure. This reduces the feeling of tightness at the backhand side of the base portion of the thumb when the glove is worn, and thus contributes to a better fit of the glove on the hand.

BEST MODE FOR CARRYING OUT THE INVENTION

Figure 1:
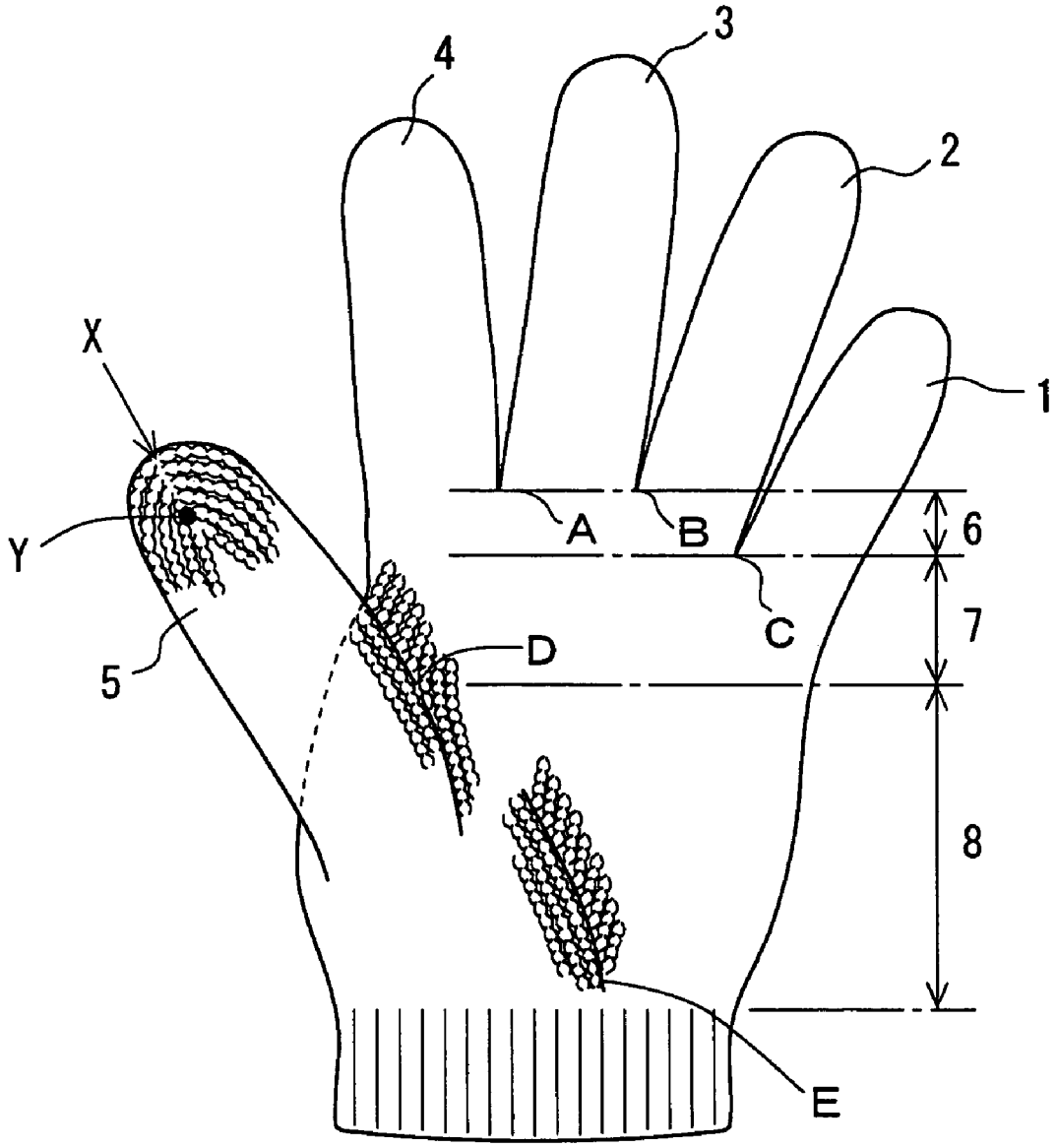
FIG. 1 illustrates a glove according to a first embodiment of the present invention as viewed from a palm-side in a state where a thumb sheath is spread out.

Embodiments of a glove and a method for knitting the glove according to the present invention will now be described with reference to the drawings.

The glove according to each embodiment is knitted by using a two-bed flat-knitting device including a pair of front and back needle beds which extend in a horizontal direction while facing each other from front and back directions. The back needle bed is movable horizontally in a racking motion. The flat-knitting device is capable of transferring stitches between the front and back needle beds.

When knitting a tubular glove in a two-bed flat-knitting device, a knitting operation is performed by using every other needle in each of the front and back needle beds. For example, odd-numbered needles of the front needle bed are mainly used for knitting a palm-side fabric-segment of the glove, whereas even-numbered needles of the back needle bed are mainly used for knitting a backhand-side fabric-segment of the glove.

Furthermore, in the front and back needle beds, the needles to be used for knitting in one of the needles beds face free needles of the other needle bed, such that these free needles are used when, for example, a loop-transferring process or a rib-knitting process is to be performed.

The use of these free needles allows knitting of texture patterns having a mixture of front stitches and back stitches, such as links, garters, and ribs, and moreover, allows transferring of stitches in the course direction so as to join the stitches together.

Moreover, when using a two-bed flat-knitting device, a transfer-jack head having transfer jacks arranged therein may be disposed above one of or each of the front and back needle beds in order to knit a fabric.

Although a two-bed flat-knitting device is used for knitting the glove in each of the embodiments, the present invention may alternatively apply a four-bed flat-knitting device, which includes an upper front-needle-bed, a lower front-needle-bed, an upper back-needle-bed, and a lower back-needle-bed to be used for a knitting operation.

For example, in a case where a four-bed flat-knitting device is used, a front fabric-segment may be knitted using the lower front-needle-bed and the upper back-needle-bed, and a back fabric-segment may be knitted using the lower back-needle-bed and the upper front-needle-bed. When knitting the front fabric-segment, all the loops of the back fabric-segment are secured to the needles in the lower back-needle-bed. On the other hand, when knitting the back fabric-segment, all the loops of the front fabric-segment are secured to the needles in the lower front-needle-bed.

In each of the embodiments, the two-bed flat-knitting device is used in order to knit a seamless and endless tubular structure that includes a little-finger sheath; a ring-finger sheath; a middle-finger sheath; an index-finger sheath; a thumb sheath; a four-finger body to which the little-finger sheath, the ring-finger sheath, the middle-finger sheath, and the index-finger sheath are joined; and a five-finger body to which the four-finger body and the thumb sheath are joined.

Regarding the joining position between the four-finger body through which the little-finger sheath, the ring-finger sheath, the middle-finger sheath, and the index-finger sheath are to be inserted, and the thumb sheath in each of the embodiments, the four-finger body and the thumb sheath are joined to each other at a position that allows the entire glove to have a three-dimensional structure that properly fits an actual human hand.

Figure 2:
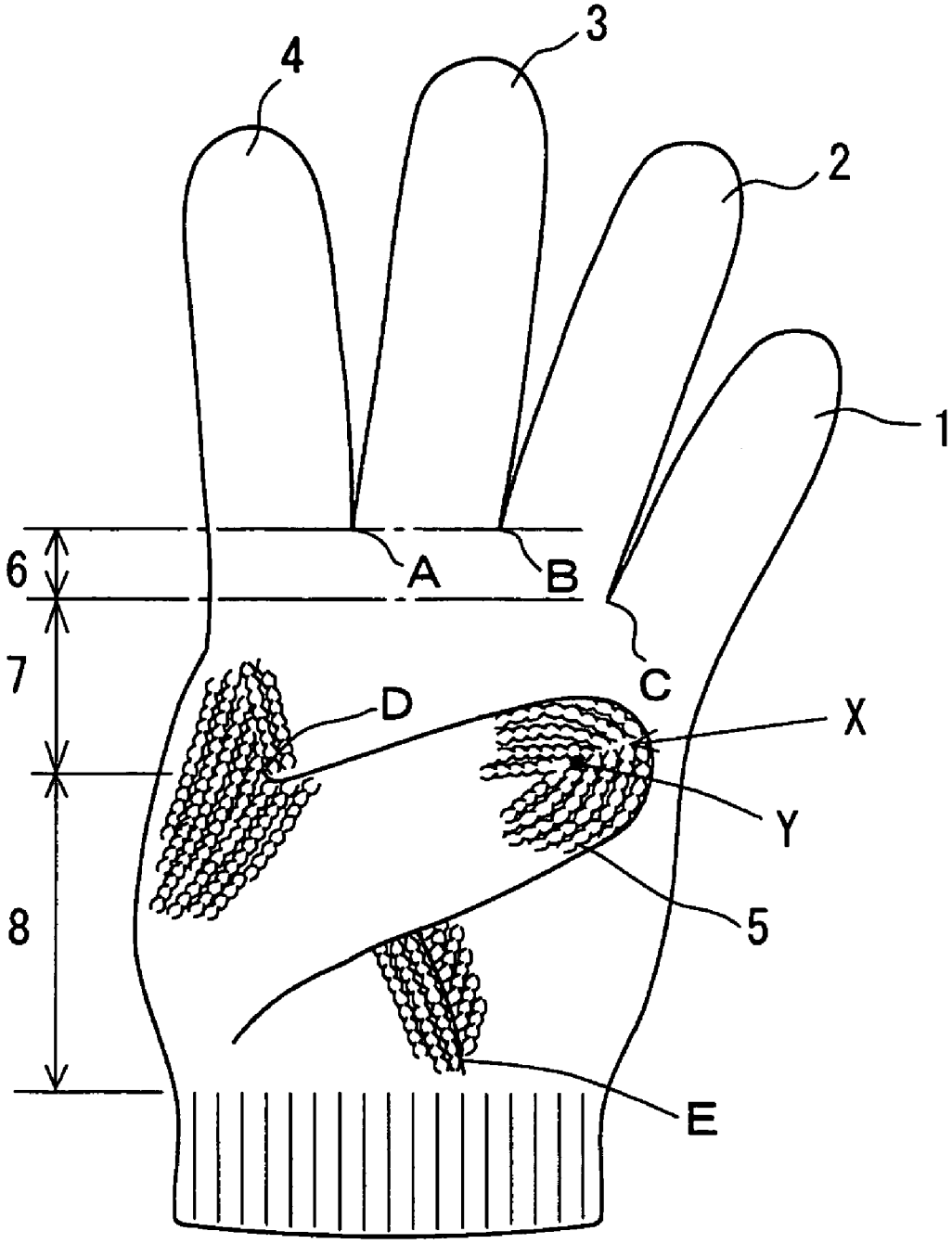
FIG. 2 illustrates the glove according to the first embodiment of the present invention as viewed from the palm-side in a state where the thumb sheath is bent towards the palm.
Figure 3:
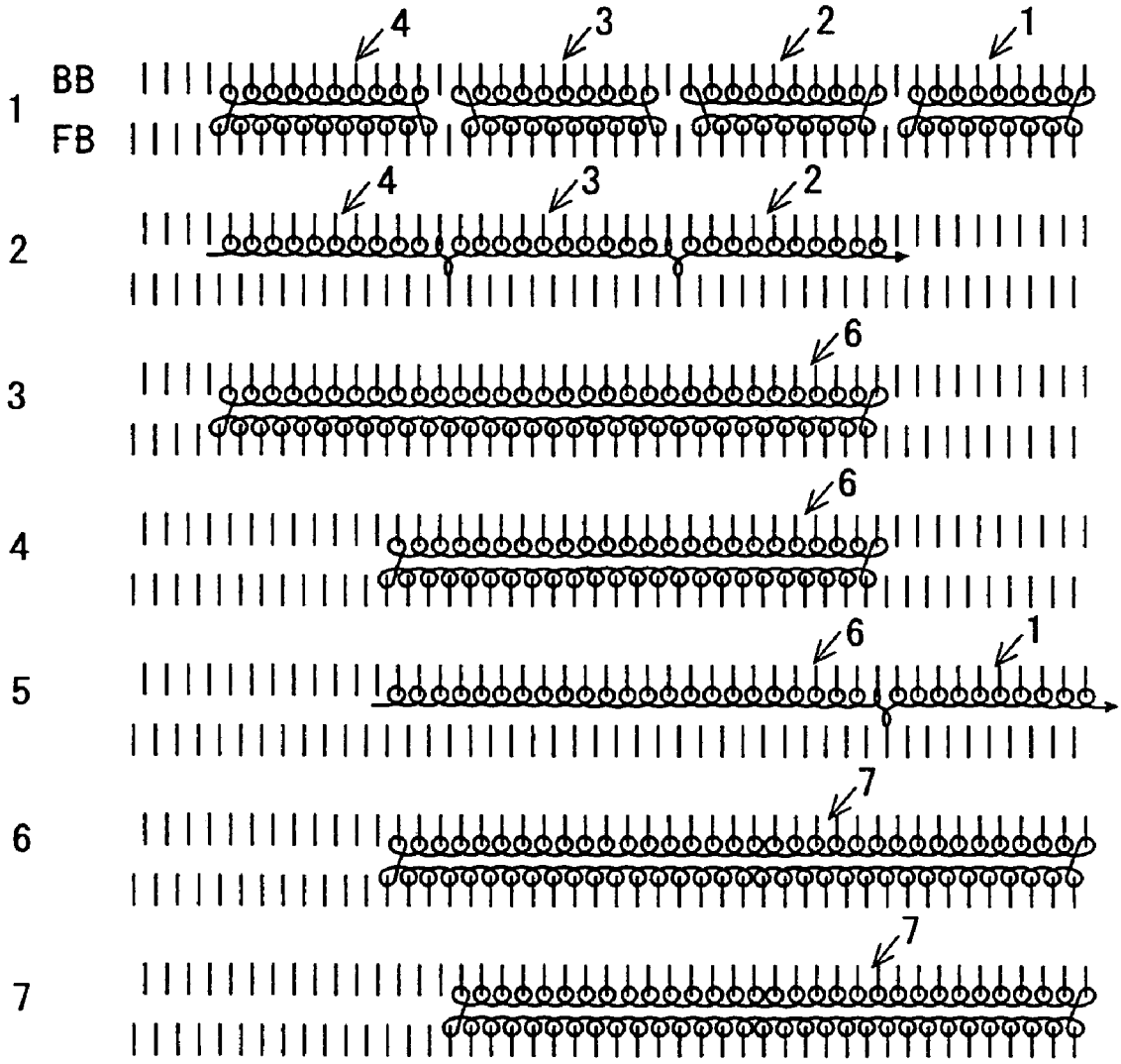
FIG. 3 illustrates steps included in a knitting method for knitting the glove according to the first embodiment.
Figure 4:
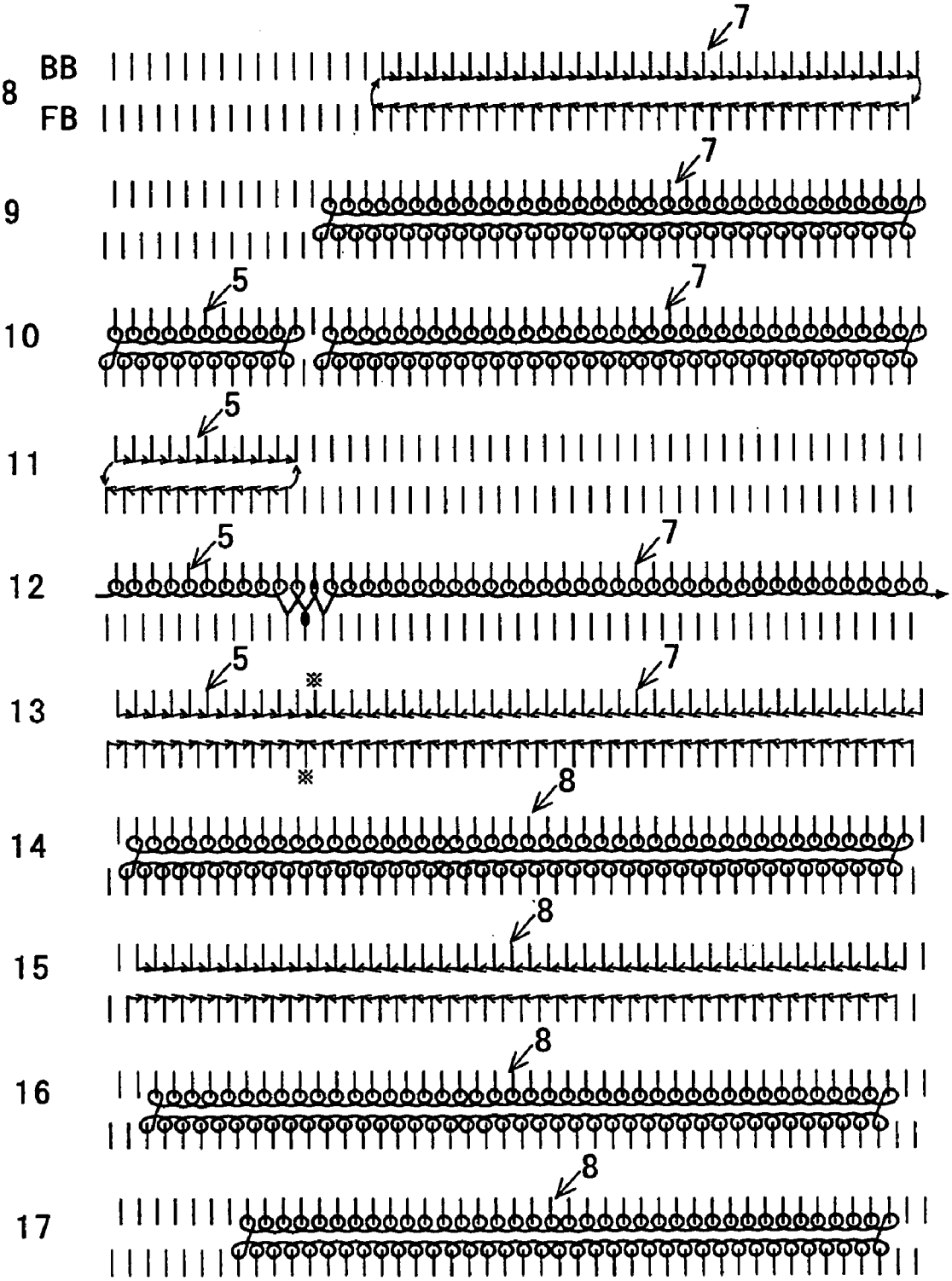
FIG. 4 illustrates further steps included in the knitting method for knitting the glove according to the first embodiment.

A first embodiment according to the present invention will now be described with reference to the relevant drawings. FIGS. 1 and 2 illustrate a glove knitted by applying the knitting method according to the present invention. FIGS. 3 and 4 illustrate the steps included in the knitting method for knitting the glove according to the first embodiment. In each of the embodiments, a broad-stitch knitting technique is used in which free needles to be used for loop-transferring are disposed between knitting needles used for forming loops. However, FIGS. 3 and 4 and FIGS. 8 and 9 according to a third embodiment, which will be described later in detail, illustrate only the loop-forming needles, meaning that the loop-transferring free needles disposed between the loop-forming needles are omitted.

The first embodiment is an example of a 7-guage medium-size glove including a little-finger sheath 1, which is knitted using 9 needles of each needle bed (a total of 18 needles with the combination of the front and back beds); a ring-finger sheath 2, which is knitted using 9 needles of the front bed and 10 needles of the back bed (a total of 19 needles with the combination of the front and back beds); a middle-finger sheath 3, which is knitted using 10 needles of each needle bed (a total of 20 needles with the combination of the front and back beds); an index-finger sheath 4, which is knitted using 11 needles of the front bed and 10 needles of the back bed (a total of 21 needles with the combination of the front and back beds); and a thumb sheath 5, which is knitted using 11 needles of each needle bed (a total of 22 needles with the combination of the front and back beds).

In the front bed (FB), the odd-numbered needles are used for forming loops, whereas in the back bed (BB), the even-numbered needles are used for forming loops.

First, the little-finger sheath 1, the ring-finger sheath 2, the middle-finger sheath 3, and the index-finger sheath 4 are knitted. In detail, the knitted fabric for each sheath includes a front fabric-segment, which defines the palm side of the sheath and is knitted by using the knitting needles of the front bed (FB); and a back fabric-segment, which defines the backhand side of the sheath and is knitted by using the knitting needles of the back bed (BB). Step 1 in FIG. 3 is a state in which the knitting process for each sheath is completed. The front fabric-segments of the little-finger sheath 1, the ring-finger sheath 2, the middle-finger sheath 3, and the index-finger sheath 4 are held by the knitting needles in a manner such that each set of adjacent front fabric-segments has one vacant knitting needle therebetween as shown in FIG. 3. Similarly, the back fabric-segments of the little-finger sheath 1, the ring-finger sheath 2, the middle-finger sheath 3, and the index-finger sheath 4 are held by the knitting needles in a manner such that each set of adjacent back fabric-segments has one vacant knitting needle therebetween as shown in FIG. 3.

In step 2, finger-converging portions among the ring-finger sheath 2, the middle-finger sheath 3, and the index-finger sheath 4 are knitted. Specifically, the back fabric-segments of the index-finger sheath 4, the middle-finger sheath 3, and the ring-finger sheath 2 are knitted in that order in a continuous manner for one course while forming increase stitches by using the vacant knitting needles (even-numbered needles) of the back bed disposed between adjacent back fabric-segments and the vacant knitting needles (odd-numbered needles) of the front bed disposed between adjacent front fabric-segments. Consequently, this forms a gusseted finger-converging portion A between the index-finger sheath 4 and the middle-finger sheath 3, and a gusseted finger-converging portion B between the middle-finger sheath 3 and the ring-finger sheath 2.

Subsequently, by performing the knitting operation from this state for one course in a circular manner, a single tubular portion begins to form. This portion allows the index-finger sheath 4, the middle-finger sheath 3, and the ring-finger sheath 2 to be linked with one another and defines a three-finger body 6 shown in step 3. In step 3, each side of the three-finger body 6 has 32 stitches that are engaged with the knitting needles of the corresponding one of the front and back beds.

By knitting the three-finger body 6 in step 3, the index-finger sheath 4, the middle-finger sheath 3, and the ring-finger sheath 2 become joined with the three-finger body 6.

Subsequently, from step 3 to step 4, the knitting process for the three-finger body 6 is further continued while shifting the stitches below the index-finger sheath 4 and the stitches below the middle-finger sheath 3 towards the ring-finger sheath 2 by decreasing the number of stitches in a bordering section between the index-finger sheath 4 and the middle-finger sheath 3 by four, and the number of stitches in a bordering section between the middle-finger sheath 3 and the ring-finger sheath 2 also by four. As a result, this achieves a state shown in step 4 in which each side of the three-finger body 6 has 24 stitches that are held by the knitting needles of the corresponding one of the front and back beds.

Specifically, all of the stitches below the middle-finger sheath 3 and the index-finger sheath 4 and the two increase stitches in the front bed are first transferred to the free needles in the back bed. A stitch in the back bed disposed at an end portion of the three-finger body 6 proximate the ring-finger sheath 2 is then transferred to a free needle in the front bed. The back bed is then moved in a racking motion in the right direction so as to allow the increase stitch formed between the ring-finger sheath 2 and the middle-finger sheath 3 to be transferred to and to overlap the stitch at the end portion of the ring-finger sheath 2. The back bed is further moved in a racking motion in the right direction so as to allow all of the stitches transferred to the free needles in the back bed to be transferred to knitting needles in the front bed. A stitch at the end portion of the middle-finger sheath 3 is overlapped with the stitch at the end portion of the ring-finger sheath 2.

Subsequently, all of the stitches below the middle-finger sheath 3 and the index-finger sheath 4 and the two increase stitches in the back bed are transferred to the free needles in the front bed. The back bed is then moved in a racking motion in the left direction so as to allow the increase stitch formed between the middle-finger sheath 3 and the ring-finger sheath 2 to be transferred to and to overlap the stitch at the end portion of the middle-finger sheath 3. The back bed is further moved in a racking motion in the left direction so as to allow all of the stitches of the middle-finger sheath 3 transferred to the free needles in the front bed to be transferred to the knitting needles in the back bed. The stitch at the end portion of the ring-finger sheath 2 is overlapped with the stitch at the end portion of the middle-finger sheath 3, and moreover, the stitch at the end portion of the three-finger body 6 proximate the ring-finger sheath 2 previously transferred to the free needle in the front bed is transferred to the back bed.

The back bed is further moved in a racking motion in the left direction so as to allow the increase stitch formed between the middle-finger sheath 3 and the index-finger sheath 4 previously transferred to the free needle in the front bed to be transferred to a knitting needle in the back bed. Moreover, the increase stitch is overlapped with the stitch at the end portion of the middle-finger sheath 3, and the stitch at the end portion of the three-finger body 6 proximate the ring-finger sheath 2 in the front bed is transferred to a free needle in the back bed.

The back bed is further moved in a racking motion in the left direction so as to allow all of the stitches of the index-finger sheath 4 transferred to the free needles in the front bed to be transferred to knitting needles in the back bed. The stitch at the end portion of the middle-finger sheath 3 is overlapped with a stitch at the end portion of the index-finger sheath 4.

Subsequently, all of the stitches of the index-finger sheath 4 held by the knitting needles of the front bed and the increase stitch formed between the middle-finger sheath 3 and the index-finger sheath 4 are transferred to the free needles in the back bed. The back bed is then moved in a racking motion in the right direction so as to allow the increase stitch to be overlapped with the stitch at the end portion of the middle-finger sheath 3, and the stitch at the end portion of the three-finger body 6 proximate the ring-finger sheath 2 previously transferred to the free needle in the back bed to be transferred to a knitting needle in the front bed.

The back bed is further moved in a racking motion in the right direction so as to allow all of the stitches of the index-finger sheath 4 transferred to the free needles in the back bed to be transferred to the knitting needles in the front bed, and the stitch at the end portion of the middle-finger sheath 3 to be overlapped with the stitch at the end portion of the index-finger sheath 4.

Accordingly, the knitting operation is performed for one course for the front and back beds with four less stitches, and is further performed for one course in the same manner with four less stitches so as to achieve the state shown in step 4.

As shown in step 5, a finger-converging portion C between the three-finger body 6 and the little-finger sheath 1 is then knitted. Similar to the above, the back fabric-segments for the three-finger body 6 and the little-finger sheath 1 are knitted in that order in a continuous manner for one course while forming increase stitches by using the vacant knitting needle of the back bed disposed between the adjacent back fabric-segments and the vacant knitting needle of the front bed disposed between the adjacent front fabric-segments. Consequently, this forms a gusseted finger-converging portion C.

Subsequently, by performing the knitting operation from this state for one course in a circular manner, a single tubular portion begins to form. This portion allows the three-finger body 6 and the little-finger sheath 1 to be linked with each other and defines a four-finger body 7 shown in step 6. In step 6, each side of the four-finger body 7 has 34 stitches that are held by the knitting needles of the corresponding one of the front and back beds.

By knitting the four-finger body 7 in step 6, the three-finger body 6 and the little-finger sheath 1 become joined with each other.

Subsequently, from step 6 to step 7, the knitting process for the four-finger body 7 is further continued while shifting the stitches below the three-finger body 6 towards the little-finger sheath 1 by decreasing the number of stitches in a bordering section between the three-finger body 6 and the little-finger sheath 1 by three. As a result, this achieves a state shown in step 7 in which each side of the four-finger body 7 has 31 stitches that are held by the knitting needles of the corresponding one of the front and back beds.

From the state shown in step 7, the knitted fabric of the four-finger body 7 is subject to a rotational operation as shown in step 8 of FIG. 4. In detail, such a rotational operation is performed by racking the back bed such that the stitches at the end portions of one of the fabric-segments held by the front and back beds are transferred to the knitting needles adjacent to the end portions of the other fabric-segment held by the opposing bed. After the rotational operation for the four-finger body 7, a circular knitting operation is performed in a repetitive manner for a predetermined number of courses while forming increase stitches in each course to increase the knitting width of the four-finger body 7. Accordingly, this achieves the state shown in step 9.

The direction for the rotational operation corresponds to a direction in which the thumb sheath 5 is biased towards the center of the palm. The increase stitches are formed adjacent to an end portion of the four-finger body 7 where the thumb sheath 5 is to be joined (the left end-portion of the four-finger body in step 9).

The operation for knitting the glove shown in FIGS. 3 and 4 is for knitting a right-hand glove. For knitting a right-hand glove, the direction for the rotational operation in step 8 is in the left direction such that an end portion of the front fabric-segment proximate the thumb sheath is rotated to the left by the back bed.

The rotational operation will be described in further detail. The back head is moved in a racking motion to the right so as to transfer the right-end stitch of the back fabric-segment of the four-finger body 7 to the right side of the right-end stitch of the front fabric-segment of the four-finger body 7. At the same time, the left-end stitch of the front fabric-segment of the four-finger body 7 is transferred to the left side of the left-end stitch of the back fabric-segment of the four-finger body 7. Thus, a rotational operation for rotating by a distance of one stitch is performed.

Subsequently, the back bed is moved in a racking motion further to the right so as to transfer the right-end loop held by the back bed to a needle at the right side of the right-end loop held by the front bed. At the same time, the left-end loop held by the front bed is transferred to a needle at the left side of the left-end loop held by the back bed. Thus, another rotational operation for rotating by a distance of one stitch is performed.

Accordingly, in such rotational operation where the right and left ends of the fabric segments held by the back and front beds are moved in a stitch-by-stitch manner, if the rotational operation for rotating by a distance of one stitch is defined as one cycle, the joining position between the four-finger body 7 and the thumb sheath 5 can be adjusted by controlling the number of repeating cycles for the rotational operation.

In the first embodiment, the rotational operation for the four-finger body 7 is performed such that the stitches of the four-finger body 7 are rotated by 1/10 of a round, that is, by a distance of seven needles in step 8 shown in FIG. 4.

After the knitting process for increasing the knitting width of the four-finger body 7 is performed, a knitting process for the thumb sheath 5 is performed. The tubular knitted-fabric forming the thumb sheath 5 and the tubular knitted-fabric forming the four-finger body 7 are formed between the front and back beds such that the two have one needle worth of gap therebetween. This achieves a state shown in step 10.

Subsequently, as shown in step 11, the knitted fabric of the thumb sheath 5 held by the knitting needles is subject to a rotational operation. According to the first embodiment, the rotational operation for the thumb sheath 5 is performed in the following manner. By racking the back bed repetitively for a predetermined number of pitches, the stitches at the end portions of one of the fabric-segments of the thumb sheath 5 held by the corresponding bed are transferred to the knitting needles of the opposing bed.

In the final course of the knitting process for the thumb sheath 5 shown in step 10, the number of stitches subject to the rotational operation is preliminarily twisted in order to prevent the stitches from tangling during the transferring process.

The direction for the rotational operation corresponds to a direction in which the stitch of the thumb sheath 5 disposed the farthest from the four-finger body 7 rolls toward the palm by 1/4 of a round or less. In the first embodiment, the rotational operation is performed for 1/4 of a round, that is, by a distance of six needles in FIG. 4.

The thumb sheath 5 is preferably rotated within a range of 3/20 of a round to 1/4 of a round from the state in which the four-finger body 7 and the thumb sheath 5 are not yet joined to each other. The rotating direction corresponds to a direction in which the stitch of the thumb sheath 5 disposed the farthest from the four-finger body 7 rolls toward the palm.

Subsequently, in step 12, a finger-converging portion D between the four-finger body 7 and the thumb sheath 5 is knitted. Specifically, the back fabric-segments of the thumb sheath 5 and the four-finger body 7 are knitted in that order in a continuous manner for one course while forming increase stitches by using a vacant knitting needle of the back bed disposed between the back fabric-segments of the thumb sheath 5 and the four-finger body 7 and a vacant knitting needle of the front bed disposed between the front fabric-segments of the thumb sheath 5 and the four-finger body 7. Moreover, the opposing needles with the increase stitches are tacked. Accordingly, a gusseted finger-converging portion D is formed.

After the knitting process of step 12, two stitches adjacent to each increase stitch are transferred to the needle with the corresponding increase stitch (at a position indicated by *) as shown in step 13, while all of the stitches are transferred to their adjacent needles in a manner such that each increase stitch is overlapped with its two adjacent stitches.

After the transferring of stitches, a knitting operation for one course is performed between the front and back beds, as shown in step 14. Furthermore, as shown in step 15, the two stitches adjacent to each increase stitch are again transferred to the needle with the corresponding increase stitch, while all of the stitches are transferred to their adjacent needles in a manner such that each increase stitch is overlapped with its two adjacent stitches. Subsequently, as shown in step 16, a knitting operation for one course is performed between the front and back beds, whereby the knitting process for the finger-converging portion D is completed. In step 16, each side of a five-finger body 8 has 42 stitches that are held by the knitting needles of the corresponding one of the front and back beds.

By knitting the five-finger body 8 from step 12 to step 16, the four-finger body 7 and the thumb sheath 5 become joined with each other.

After the four-finger body 7 and the thumb sheath 5 are joined with each other in step 16, a knitting process for reducing the knitting width of the five-finger body 8 is performed.

The knitting process for reducing the knitting width of the five-finger body 8 is performed by overlapping the stitches of the five-finger body 8 extending continuously from the stitches of the thumb sheath 5 in the wale direction with the stitches of the five-finger body 8 extending continuously from the stitches of the four-finger body 7 in the wale direction. Such overlapping is performed for a predetermined number of courses.

In the first embodiment, from a side of the palm-side fabric-segment proximate the thumb sheath, the stitches of the five-finger body 8 extending continuously from the stitches of the four-finger body 7 in the wale direction overlap the stitches of the five-finger body 8 extending continuously from the stitches of the thumb sheath 5 in the wale direction for a predetermined number of courses. This achieves the completed five-finger body 8 shown in step 17.

Then, continuing from the five-finger body 8, a wrist portion is rib-knitted so as to complete the entire knitting operation of the glove.

As described above, in the glove according to the first embodiment, the stitches of the four-finger body 7 are rotated by 1/10 of a round, that is, by a distance of seven needles in step 8 in FIG. 4, and moreover, the stitches of the thumb sheath 5 are rotated by 1/4 of a round, that is, by a distance of six needles in step 11 shown in FIG. 4. Subsequently, the knitting process for joining together the thumb sheath 5 and the four-finger body 7 is performed. For this reason, as shown in FIGS. 1 and 2, the base portion of the thumb sheath 5 is attached close to the center of the palm portion of the five-finger body 8 while the stitches at the fingertip portion of the thumb sheath 5 are rotated by 1/4 of a round. Accordingly, this achieves a three-dimensional glove that properly fits an actual human hand.

As a result, since the four-finger body 7 and the thumb sheath 5 are joined with each other after the rotational operation for the four-finger body 7, a three-dimensional glove that can properly fit an actual human hand can be achieved. Moreover, this reduces the feeling of tightness at the backhand side of the base portion of the thumb when the glove is worn, which can be seen in conventional gloves, and thus contributes to a better fit of the glove on the hand.

Furthermore, the rotational operation for the thumb sheath 5 prevents the body portion of a human thumb from being in contact with bulging portions Y disposed at opposite sides of a fingertip curve-line X formed at the tip of the thumb sheath 5. This prevents a sense of discomfort when the glove is worn and thus contributes to better workability.

Furthermore, since the knitting process for increasing the knitting width of the four-finger body 7 is performed in order to increase the dimension of the four-finger body 7 in the width direction of the glove before joining the four-finger body 7 and the thumb sheath 5 together, a good appearance of the glove can be achieved without having to stretch the stitches. This further reduces the feeling of tightness at the backhand side of the base portion of the thumb when the glove is worn.

Furthermore, since the knitting process for reducing the knitting width of the five-finger body 8 is performed after the four-finger body 7 and the thumb sheath 5 are joined with each other, a shape more similar to that of a human hand can be achieved. Moreover, this prevents the wrist portion from becoming loose even if the knitting width of the four-finger body 7 is increased.

In particular, regarding the reduction of the knitting width of the five-finger body 8, the number of stitches in the five-finger body 8 is decreased at a section between the stitches continuously extending from the thumb sheath 5 and the stitches continuously extending from the four-finger body 7. For this reason, even if a decrease-stitch line (a line indicated by reference character E in FIGS. 1 and 2) may appear in the inner portion of the palm, the decrease-stitch line will be disposed along a valley line formed at the base portion of the thumb sheath. Consequently, this contributes to a good appearance of the glove.

The knitting process for reducing the knitting width of the five-finger body 8 may alternatively be performed in a manner such that the stitches are decreased near the side of the thumb sheath proximate the palm instead of being decreased at the central portion of the palm.

Furthermore, although the rotational operation is performed for both the thumb sheath 5 and the four-finger body 7 in the first embodiment, the rotational operation may alternatively be performed only for the thumb sheath 5, or only for the four-finger body 7.

Figure 5:
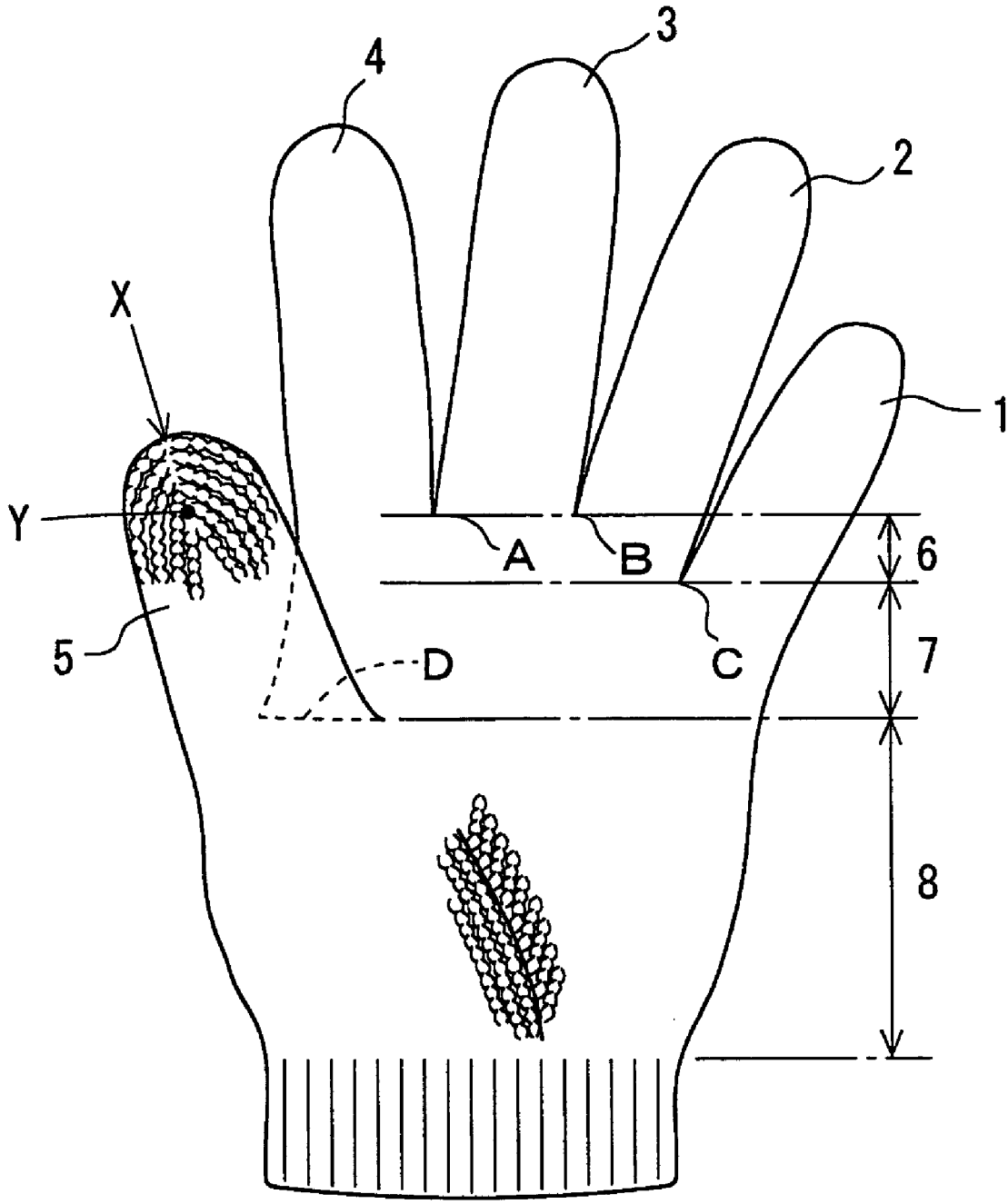
FIG. 5 illustrates a glove according to a second embodiment of the present invention as viewed from the palm-side in a state where the thumb sheath is spread out.

A second embodiment will now be described. In the second embodiment, the knitting process and the rotational operation for the thumb sheath 5 are performed in the same manner as in the first embodiment. On the other hand, a knitting process for joining the thumb sheath 5 to the four-finger body 7 at a position closer towards the center of the palm, as shown in FIG. 5, is performed with the following procedure based on knitting steps (shown in FIG. 6) for knitting the glove.

The knitting operation for the glove according to the second embodiment applies the same steps as step 1 to step 7 shown in FIG. 3 according to the first embodiment, and therefore, the description of these steps will be omitted.

In the second embodiment, the knitting width of the four-finger body 7 is increased with increase stitches before forming the finger-converging portion D between the four-finger body 7 and the thumb sheath 5. These increase stitches are formed at a side of the four-finger body 7 to which the thumb sheath 5 is to be joined.

Figure 6:
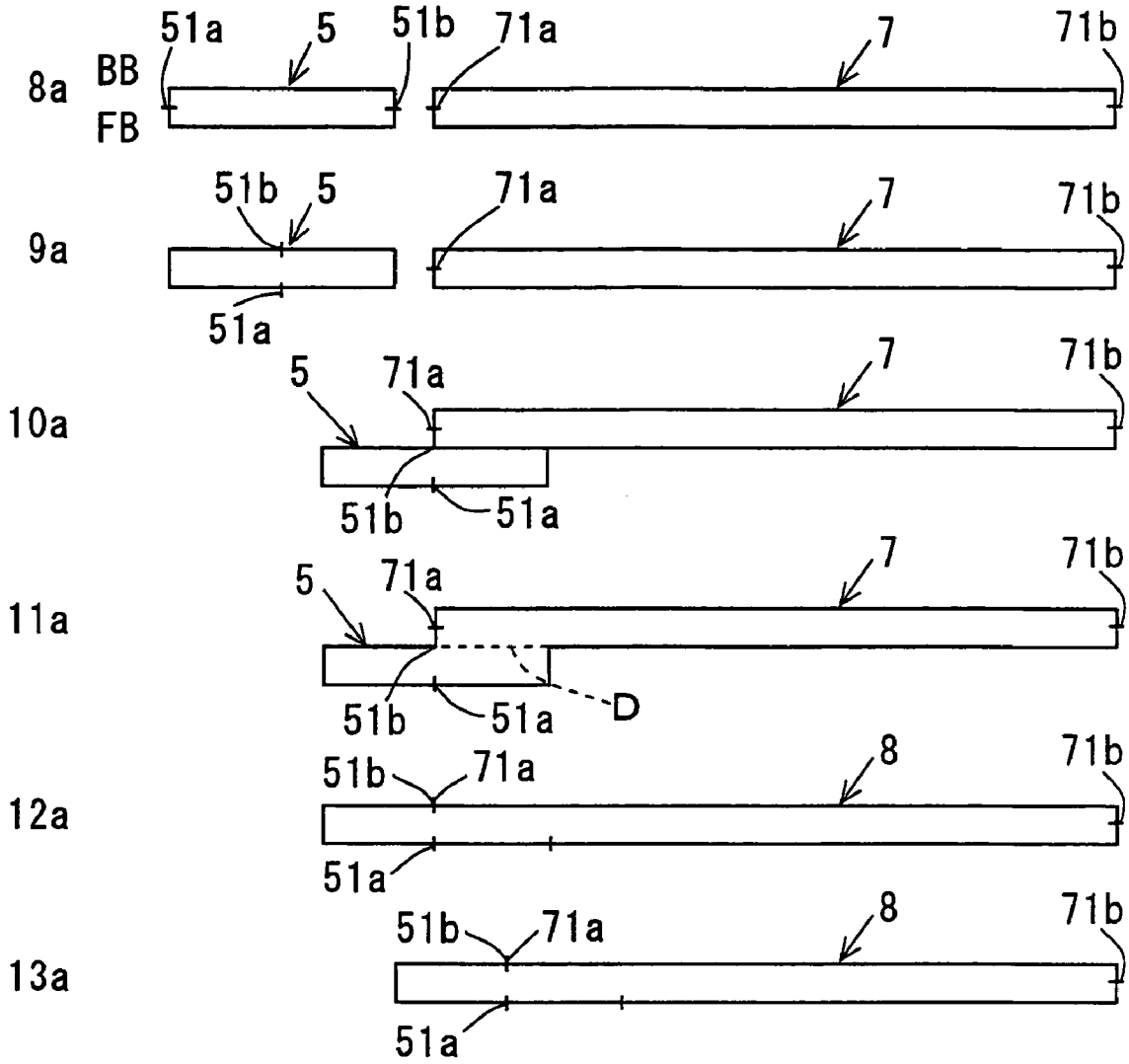
FIG. 6 illustrates steps included in a knitting method for knitting the glove according to the second embodiment.

After the knitting process of the four-finger body 7 is completed, a knitting process for the thumb sheath 5 shown in step 8*a* in FIG. 6 is performed. Then, as shown in step 9*a*, the knitted fabric of the thumb sheath 5 held by the knitting needles are subject to a rotational operation, which is performed in the same manner as step 11 according to the first embodiment. Specifically, the rotational operation is performed by racking the back bed repetitively for a predetermined number of pitches so that the stitches at the end portions of each of the fabric-segments of the thumb sheath 5 held by the corresponding bed are transferred to the corresponding knitting needles of the opposing bed.

In the second embodiment shown in FIG. 6, just after the knitting process for the thumb sheath 5 in step 8*a*, the thumb sheath 5 has border lines 51*a* and 51*b* between the front bed and the back bed, and the four-finger body 7 has border lines 71*a* and 71*b* between the front bed and the back bed. The distance to be rotated by in the rotational operation is determined based on the border lines 51*a* and 51*b* of the thumb sheath 5.

The direction for the rotational operation corresponds to a direction in which the stitch of the thumb sheath 5 at a side distant from the four-finger body 7 (the border line 51*a*) approaches the four-finger body 7 and rolls toward the palm by ¼ of a round or less. In the second embodiment, the amount of rotation is ¼ of a round.

Subsequently, as shown in step 10*a*, on the palm-side of the four-finger body 7, some of the stitches of the thumb sheath 5 are overlapped with a predetermined number of stitches of the four-finger body 7 from an end (border line 71*a*) of the four-finger body 7 proximate the index-finger sheath. First, all of the stitches of the four-finger body 7 held by the front bed are transferred to free needles disposed between the stitches held by the back bed, and moreover, all of the stitches of the thumb sheath 5 held by the back bed are transferred to free needles disposed between the stitches held by the front bed.

Then, the back bed is moved in a racking motion until some of the stitches of the thumb sheath 5 overlap some of the stitches of the four-finger body 7. In the overlapping section between the stitches of the thumb sheath 5 and the stitches of the four-finger body 7, the front-side stitches of the four-finger body 7 previously transferred to the free needles of the back bed are transferred to the knitting needles holding the stitches of the thumb sheath 5. Only the overlapping stitches (dotted line D) are cast off so as to achieve the state shown in step 11*a*.

The cast-off process in step 11*a* forms the finger-converging portion D between the thumb sheath 5 and the four-finger body 7 shown in FIG. 5.

Subsequently, all of the stitches of the four-finger body 7 transferred to the free needles of back bed in step 10*a* are transferred to the knitting needles of the front bed, and moreover, all of the stitches of the thumb sheath 5 transferred to the free needles of the front bed in step 10*a* are transferred to the knitting needles of the back bed, thereby achieving the state shown in step 12*a*.

The knitting process for the five-finger body 8 is performed from the state shown in step 12*a*. By knitting the five-finger body 8, the four-finger body 7 and the thumb sheath 5 become joined with each other.

Furthermore, as shown in step 13*a*, after the four-finger body 7 and the thumb sheath 5 are joined with each other, a knitting process for reducing the knitting width of the five-finger body 8 is performed.

The knitting process for reducing the knitting width of the five-finger body 8 is performed by overlapping the stitches of the five-finger body 8 extending continuously from the stitches of the thumb sheath 5 in the wale direction with the stitches of the five-finger body 8 extending continuously from the stitches of the four-finger body 7 in the wale direction. The knitting process for reducing the knitting width of the five-finger body 8 may alternatively be performed in a manner such that the stitches are decreased near the side of the palm proximate the thumb sheath instead of being decreased at the central portion of the palm.

After the five-finger body 8 is knitted, a wrist portion continuing from the five-finger body 8 is rib-knitted so as to complete the entire knitting operation of the glove.

In the first and second embodiments, although the knitting width of the four-finger body 7 is increased before joining the four-finger body 7 and the thumb sheath 5 together, and the knitting width of the five-finger body 8 is reduced after the four-finger body 7 and the thumb sheath 5 are joined with each other, the glove may alternatively be knitted without increasing the knitting width of the four-finger body 7 and reducing the knitting width of the five-finger body 8.

On the other hand, if the knitting width of the five-finger body 8 is to be reduced, the knitting process is preferably performed in a manner such that the knitting width of the palm-side fabric-segment is decreased, and is more preferably performed such that the number of stitches is decreased at a bordering section between the thumb sheath 5 and the four-finger body 7.

In the second embodiment, the rotational operation for the thumb sheath 5 prevents the body portion of a human thumb from being in contact with the bulging portions Y disposed at opposite sides of the fingertip curve-line X formed at the tip of the thumb sheath 5. This prevents a sense of discomfort when the glove is worn and thus contributes to better workability.

Furthermore, since the finger-converging portion D between the thumb sheath 5 and the four-finger body is formed by overlapping the thumb sheath 5 with the palm-side fabric-segment of the four-finger body 7 at the end portion (border line 71*a*) of the four-finger body 7 proximate the index-finger sheath, a shape more similar to that of an actual human hand can be achieved. This reduces the feeling of tightness at the backhand side of the base portion of the thumb when the glove is worn, and thus contributes to a better fit of the glove on the hand.

Furthermore, since the knitting process for increasing the knitting width of the four-finger body 7 is performed in order to increase the dimension of the four-finger body 7 in the width direction of the glove before joining the four-finger body 7 and the thumb sheath 5 together, the feeling of tightness at the backhand side of the base portion of the thumb is further reduced when the glove is worn, and moreover, a bad appearance of the glove due to stretched stitches is prevented.

Furthermore, since the knitting process for reducing the knitting width of the five-finger body 8 is performed after the four-finger body 7 and the thumb sheath 5 are joined with each other, a shape more similar to that of a human hand can be achieved. Moreover, this prevents the wrist portion from becoming loose even if the knitting width of the four-finger body 7 is increased.

Furthermore, although the rotational operation for the thumb sheath 5 is performed in the second embodiment, the four-finger body 7 and the thumb sheath 5 may alternatively be joined with each other at a position closer towards the palm without performing the rotational operation for the thumb sheath 5.

Moreover, in the second embodiment, the sheaths excluding the thumb sheath may alternatively be joined with one another by applying the same approach as that for joining the thumb sheath with the four-finger body.

Figure 7:
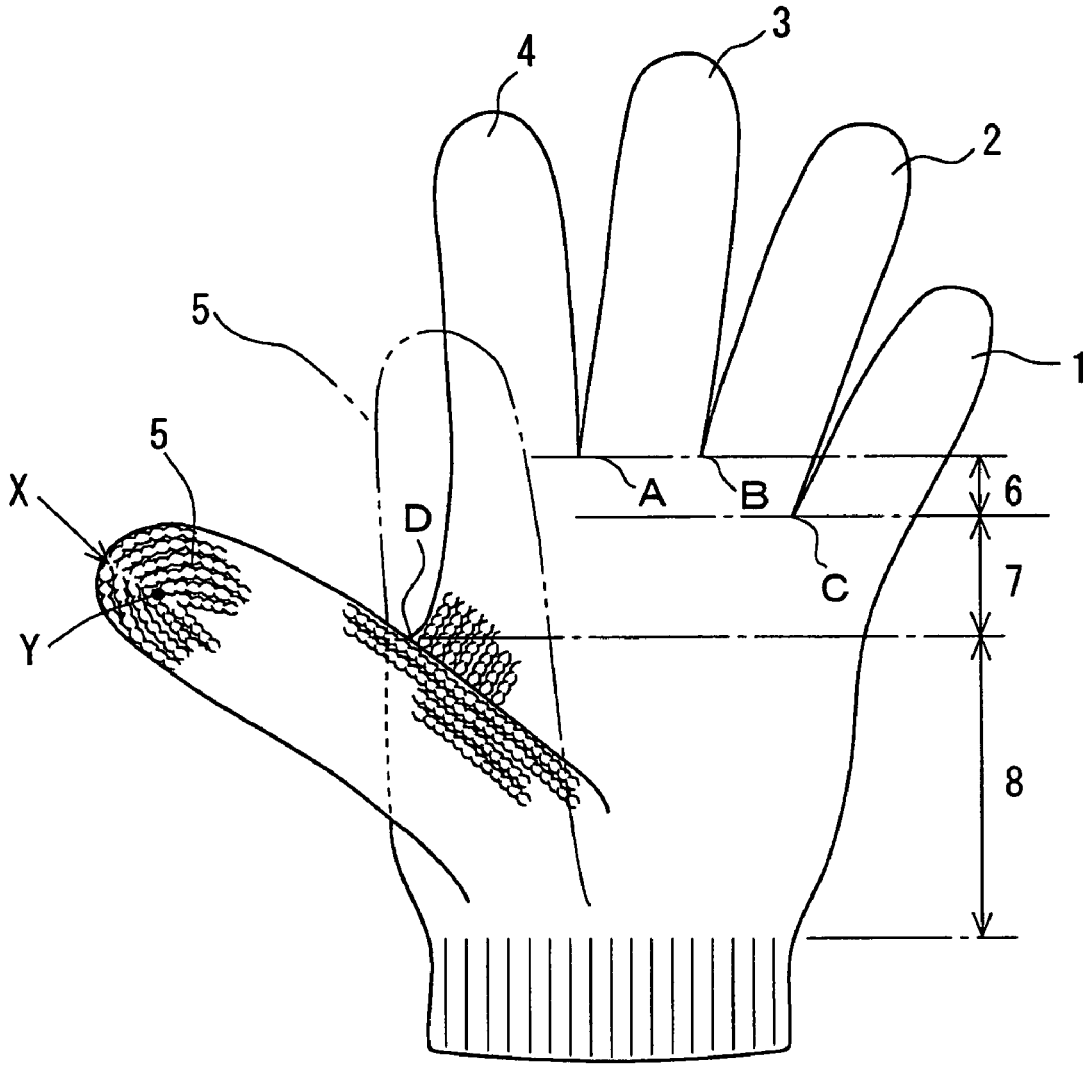
FIG. 7 illustrates a glove according to a third embodiment of the present invention as viewed from the palm-side.

A third embodiment will now be described. The glove according to the third embodiment is knitted in a manner such that the knitting process for the five-finger body 8 is performed while reducing the knitting width of the palm-side fabric-segment of the five-finger body 8. In detail, the five-finger body 8 is knitted while overlapping the stitches of the five-finger body 8 extending continuously from the stitches of the four-finger body 7 in the wale direction with the stitches of the five-finger body 8 extending continuously from the stitches of the thumb sheath 5 in the wale direction for a predetermined number of courses from a side of the palm-side fabric-segment proximate the thumb sheath. Thus, as shown in FIG. 7, the joining position between the thumb sheath 5 and the four-finger body 7 of the glove is disposed closer towards the center of the palm.

The knitting operation for the glove according to the third embodiment is performed with the following procedure based on knitting steps (shown in FIGS. 8 and 9) for knitting the glove. Since the same steps as step 1 to step 7 shown in FIG. 3 according to the first embodiment are applied to the knitting operation, the description of these steps will be omitted.

Figure 8:
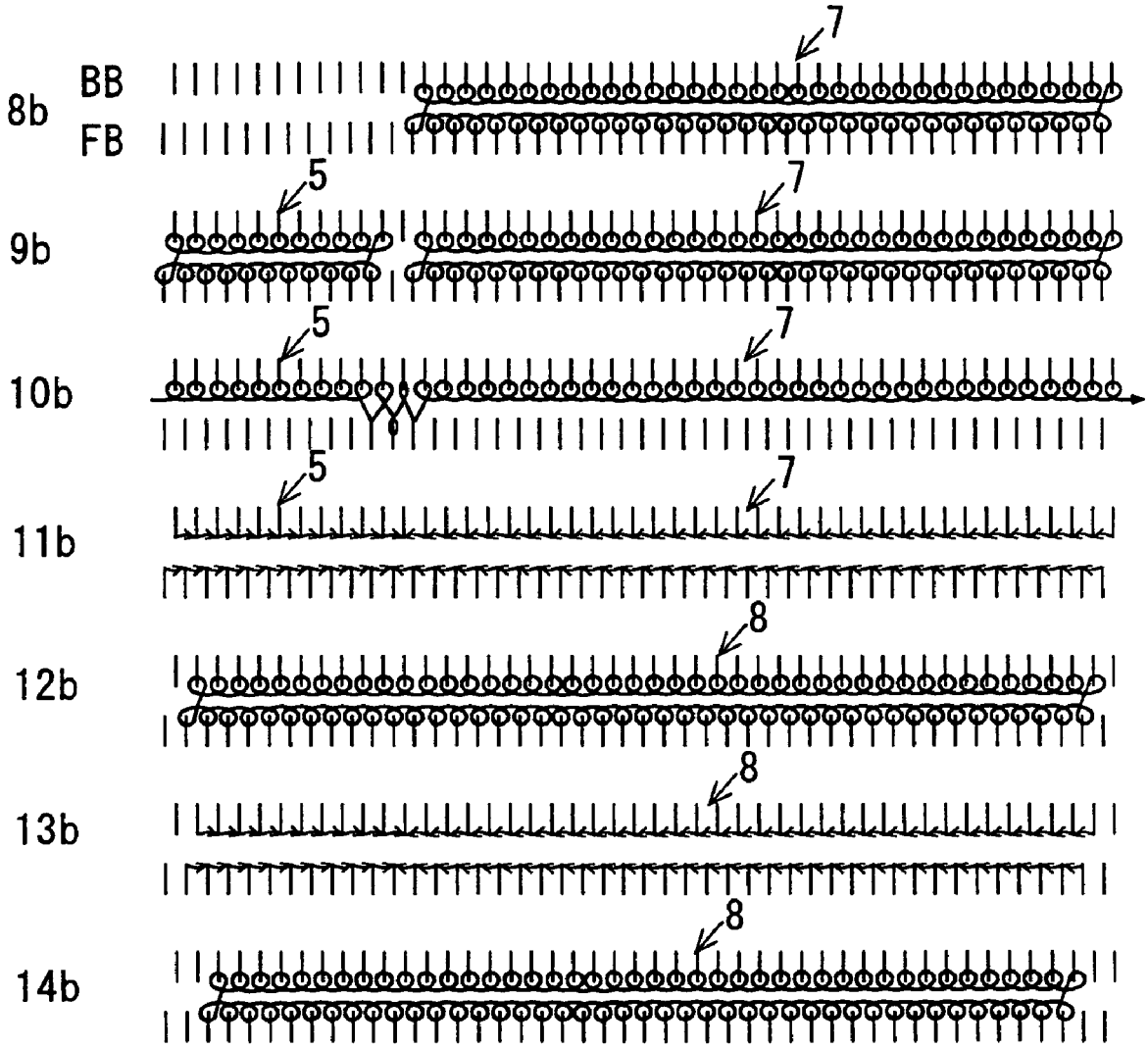
FIG. 8 illustrates steps included in a knitting method for knitting the glove according to the third embodiment.
Figure 9:
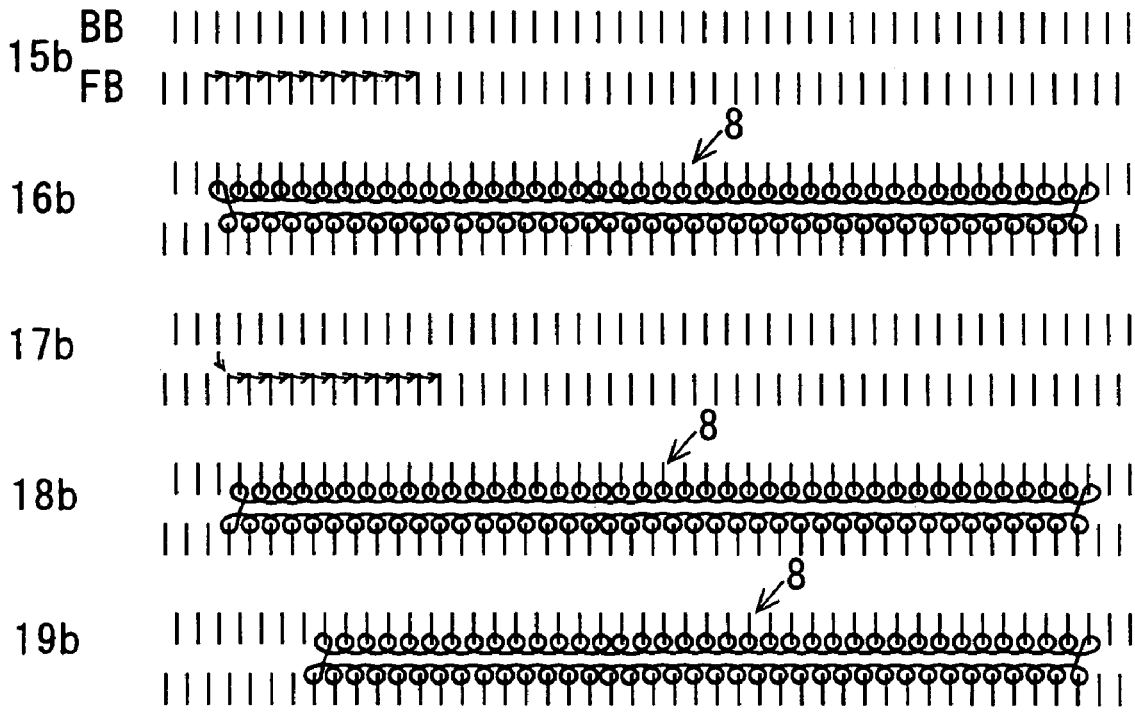
FIG. 9 illustrates further steps included in the knitting method for knitting the glove according to the third embodiment.
Figure 10:
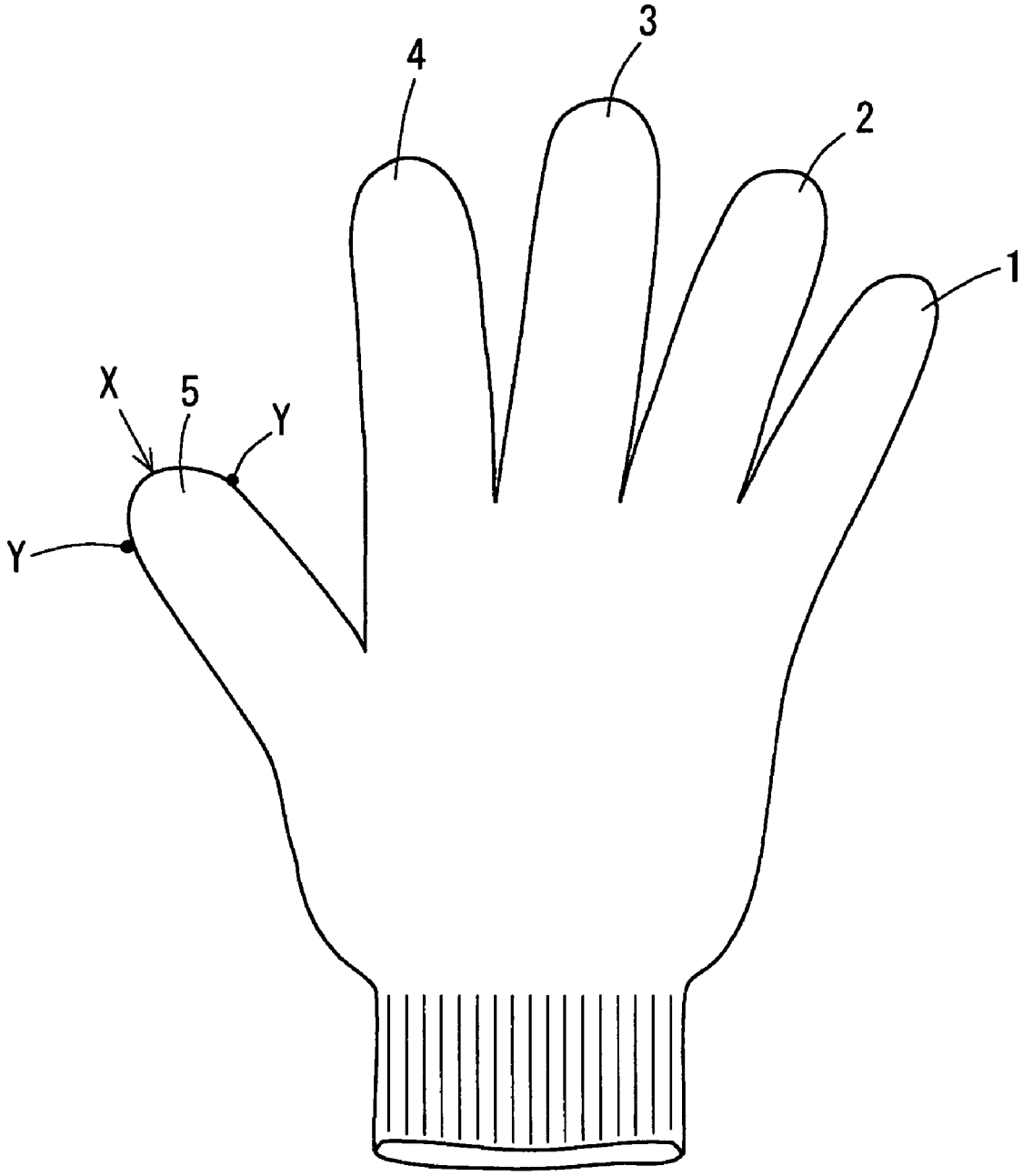
Fig. 10 Prior Art
FIG. 10 is a plan view of a conventional glove.

In the third embodiment, as shown in step 8*b* in FIG. 8, the knitting width of the four-finger body 7 is increased with increase stitches before forming the finger-converging portion D between the four-finger body 7 and the thumb sheath 5. These increase stitches are formed adjacent to an end portion of the four-finger body 7 to which the thumb sheath 5 is to be joined.

After the knitting process of the four-finger body 7 is completed, a knitting process for the thumb sheath 5 shown in step 9*b* is performed.

Then, as shown in step 10*b*, the finger-converging portion D is formed between the four-finger body 7 and the thumb sheath 5. Specifically, the back fabric-segments of the thumb sheath 5 and the four-finger body 7 are knitted in that order in a continuous manner for one course while forming increase stitches by using a vacant knitting needle of the back bed disposed between the back fabric-segments of the thumb sheath 5 and the four-finger body 7 and a vacant knitting needle of the front bed disposed between the front fabric-segments of the thumb sheath 5 and the four-finger body 7. Moreover, the opposing needles with the increase stitches are tacked. Accordingly, a gusseted finger-converging portion D is formed.

After the knitting process of step 10*b*, two stitches adjacent to each increase stitch are transferred to the needle with the corresponding increase stitch as shown in step 11*b*, while all of the stitches are transferred to their adjacent needles in a manner such that each increase stitch is overlapped with its two adjacent stitches.

After the transferring of stitches, a knitting operation for one course is performed between the front and back beds, as shown in step 12*b*. Subsequently, as shown in step 13*b*, the two stitches adjacent to each increase stitch are again transferred to the needle with the corresponding increase stitch, while all of the stitches are transferred to their adjacent needles in a manner such that each increase stitch is overlapped with its two adjacent stitches. Then, as shown in step 14*b*, a knitting operation for one course is performed between the front and back beds, whereby the knitting process for the finger-converging portion D is completed.

By knitting the five-finger body 8 from step 10*b* to step 14*b*, the four-finger body 7 and the thumb sheath 5 become joined with each other.

After the four-finger body 7 and the thumb sheath 5 are joined with each other in step 14*b*, a knitting process for reducing the knitting width of the five-finger body 8 is performed. This process is performed while rotating the thumb sheath 5 so that the joining position between the thumb sheath 5 and the four-finger body 7 is set closer towards the center of the palm.

As shown in step 15*b* to step 18*b*, the knitting process for reducing the knitting width of the five-finger body 8 is performed by overlapping the stitches of the five-finger body 8 extending continuously from the stitches of the thumb sheath 5 in the wale direction with the stitches of the five-finger body 8 extending continuously from the stitches of the four-finger body 7 in the wale direction. Such overlapping is performed for a predetermined number of courses.

In detail, as shown in step 15*b*, of the stitches of the five-finger body 8 extending continuously from the stitches of the thumb sheath 5 in the wale direction, all stitches held by the front bed are transferred to the free needles of the back bed. The back bed is then moved in a racking motion in the right direction, and all of the stitches transferred to the free needles of the back bed are transferred to the knitting needles of the front bed. Thus, the stitches proximate the thumb sheath 5 become overlapped with the stitches proximate the four-finger body 7, thereby achieving the state shown in step 16*b*. In step 16*b*, a knitting operation for one course is performed between the front and back beds.

Subsequently, as shown in step 17*b*, of the stitches of the five-finger body 8 extending continuously from the stitches of the thumb sheath 5 in the wale direction, all stitches held by the front bed are transferred to the free needles of the back bed. The back bed is then moved in a racking motion in the right direction, and all of the stitches transferred to the free needles of the back bed and the stitches held by the knitting needles of the back bed at a side proximate the thumb sheath are transferred to the front bed. Thus, the stitches proximate the thumb sheath 5 become overlapped with the stitches proximate the four-finger body 7, thereby achieving the state shown in step 18*b*.

By repeating the process from step 17*b* to step 18*b* for a predetermined number of courses, the state shown in step 19*b* is achieved in which the knitting process of the five-finger body 8 is completed. Then, continuing from the five-finger body 8, a wrist portion is rib-knitted so as to complete the entire knitting operation of the glove.

On the other hand, from step 17*b* onward, when the knitting operation is to be performed for one course before each transferring process, the stitches before being transferred and held by the knitting needles of the back bed at a side proximate the thumb sheath are formed into twisted loops, such that the twisting direction is opposite to the direction in which the stitches are to be twisted during the transferring process.

In the third embodiment, when the knitting process for the five-finger body 8 is completed, the joining position between the thumb sheath 5 and the four-finger body 7 is biased towards the center of the palm as shown in FIG. 7, such that a cast-on turning point at the tip of the thumb sheath 5 is rotated towards the palm.

In FIG. 7, a solid line indicates a state of the thumb sheath 5 in which the thumb sheath 5 is spread out, whereas a double-dotted chain line indicates a state of the thumb sheath 5 in which the thumb sheath 5 is bent towards the palm.

In the third embodiment, the knitting process for reducing the knitting width of the five-finger body 8 allows the thumb sheath 5 to be joined with a side of the palm-side fabric-segment of the four-finger body 7 proximate the inner portion of the thumb sheath 5. Accordingly, a glove having a shape similar to that of an actual human hand is achieved. This reduces the feeling of tightness at the backhand side of the base portion of the thumb when the glove is worn, and thus contributes to a better fit of the glove on the hand.

Furthermore, by performing the knitting process for reducing the knitting width of the five-finger body 8, the rotational operation for the thumb sheath 5 can be performed. This prevents the body portion of a human thumb from being in contact with the fingertip curve-line in the thumb sheath 5 so as to prevent a sense of discomfort when the glove is worn, thus contributing to better workability.

Moreover, since the knitting process for increasing the knitting width of the four-finger body 7 is performed in order to increase the dimension of the four-finger body 7 in the width direction of the glove before joining the four-finger body 7 and the thumb sheath 5 together, the feeling of tightness at the backhand side of the base portion of the thumb is further reduced when the glove is worn, and moreover, a bad appearance of the glove due to stretched stitches is prevented.

Furthermore, since the knitting process for reducing the knitting width of the five-finger body 8 is performed after the four-finger body 7 and the thumb sheath 5 are joined with each other, a shape more similar to that of a human hand can be achieved. Moreover, this prevents the wrist portion from becoming loose even if the knitting width of the four-finger body 7 is increased.

In particular, regarding the reduction of the knitting width of the five-finger body 8, the number of stitches in the five-finger body 8 is decreased at a section between the stitches continuously extending from the thumb sheath 5 and the stitches continuously extending from the four-finger body 7. For this reason, even if a decrease-stitch line may appear in the inner portion of the palm, the decrease-stitch line will be disposed along a valley line formed at the base portion of the thumb sheath. Consequently, this contributes to a good appearance of the glove.

Although the embodiments described above apply to working gloves, the glove and the method for knitting the glove according to the present invention may also be applied to fashionable gloves, and to types of gloves that are not provided with sheaths for the five fingers, such as mittens and fingerless-type gloves. Furthermore, although a flat-knitting technique is used for knitting fabrics in the above embodiments, other alternative knitting techniques may be used in the present invention, such as a rib-knitting technique and a texture-knitting technique.

Furthermore, in the above embodiments, although the process shown in step 2 in FIG. 3 is used for knitting the finger-converging portion between the index-finger sheath and the middle-finger sheath, the finger-converging portion between the middle-finger sheath and the ring-finger sheath, and the finger-converging portion between the ring-finger sheath and the little-finger sheath, and the process shown in step 12 in FIG. 4 is used for knitting finger-converging portion between the thumb sheath and the four-finger body, the knitting process for each finger-converging portion is not limited to the processes described in the above embodiments when the knitting operation for the glove is being performed. For example, when the gusset of each finger-converging portion is to be desirably reduced, the finger-converging portion may be knitted using the process shown in step 2 in FIG. 3, whereas when the gusset of each finger-converging portion is to be desirably increased, the finger-converging portion may be knitted using the process shown in step 12 in FIG. 4.

What is claimed is:

1. A method for knitting a glove by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds, the method comprising the steps of:

knitting a four-finger body through which a little finger, a ring finger, a middle finger, and an index finger are to be inserted;

performing a first rotational operation and a second rotational operation before joining the four-finger body with a thumb sheath, wherein the first rotational operation is performed by transferring stitches of the four-finger body held by knitting needles to free needles and moving said at least one of the front and back needles beds in a racking motion so as to rotate the four-finger body towards knitting needles holding stitches of the thumb sheath, and wherein the second rotational operation is performed by transferring the stitches of the thumb sheath held by the knitting needles to free needles and moving said at least one of the front and back needles beds in a racking motion so as to rotate the thumb sheath within a range of ¼ of a round or less; and joining the four-finger body with the thumb sheath.

2. A method for knitting a glove by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds, the method comprising the steps of:

knitting a four-finger body through which a little finger, a ring finger, a middle finger, and an index finger are to be inserted;

performing a rotational operation before joining the four-finger body with a thumb sheath, the rotational operation being performed by transferring stitches of the thumb sheath held by knitting needles to free needles and moving said at least one of the front and back needles beds in a racking motion so as to rotate the thumb sheath within a range of ¼ of a round or less;

overlapping some of the stitches of the thumb sheath with a predetermined number of stitches on a palm-side of the four-finger body from an end of the four-finger body proximate an index-finger sheath;

performing a cast-off process on the overlapping stitches; and knitting a five-finger body.

3. A method for knitting a glove by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds, the method comprising the steps of:

knitting a four-finger body through which a little finger, a ring finger, a middle finger, and an index finger are to be inserted;

knitting a thumb sheath;

joining the four-finger body with the thumb sheath; and knitting a five-finger body such that a palm-side fabric-segment of the five-finger body has a less number of stitches than a backhand-side fabric-segment of the five-finger body, whereby the thumb sheath protrudes outward from the palm-side fabric-segment of the five-finger body and is disposed in a rotating manner with respect to the palm-side fabric-segment.

4. The method for knitting the glove according to claim 3, wherein the five-finger body is knitted while an overlapping process is performed on the palm-side fabric-segment of the five-finger body for a predetermined number of courses, the overlapping process being performed from a side of the palm-side fabric-segment proximate the thumb sheath and by overlapping stitches of the five-finger body extending continuously from stitches of the four-finger body in the wale direction with stitches of the five-finger body extending continuously from stitches of the thumb sheath in the wale direction.

5. The method for knitting the glove according to claim 1, wherein, before joining the four-finger body with the thumb sheath, the four-finger body is knitted in a manner such that a knitting width of the four-finger body is increased by increasing stitches at a section of the four-finger body proximate the thumb sheath.

6. The method for knitting the glove according to claim 5, wherein, after the four-finger body is joined with the thumb sheath, the five-finger body is knitted in a manner such that a knitting width of the five-finger body is reduced.

7. The method for knitting the glove according to claim 6, wherein the five-finger body is knitted while the stitches of the five-finger body extending continuously from the stitches of the thumb sheath in the wale direction are overlapped with the stitches of the five-finger body extending continuously from the stitches of the four-finger body in the wale direction for a predetermined number of courses.

8. A glove knitted by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds, the glove comprising:

a four-finger body through which a little finger, a ring finger, a middle finger, and an index finger are to be inserted; and a thumb sheath, wherein a joining position between the four-finger body and the thumb sheath is disposed on a palm-side of the four-finger body at a section between an end of the four-finger body proximate an index-finger sheath and a center of a palm, and wherein the thumb sheath is joined with the four-finger body such that the thumb sheath is rotated within a range of ¼ of a round or less.

9. A glove knitted by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds, the glove comprising:

a four-finger body through which a little finger, a ring finger, a middle finger, and an index finger are to be inserted; and a thumb sheath, wherein some of stitches of the thumb sheath are overlapped with a predetermined number of stitches on a palm-side of the four-finger body from an end of the four-finger body proximate an index-finger sheath in a state such that the thumb sheath is rotated within a range of ¼ of a round or less, the overlapping stitches being cast off.

10. A glove knitted by using a flat-knitting device including at least a pair of front and back needle beds which extend in a horizontal direction while facing each other from front and back directions, at least one of the front and back needle beds being movable horizontally in a racking motion, the flat-knitting device capable of transferring stitches between the front and back needle beds, the glove comprising:

a four-finger body through which a little finger, a ring finger, a middle finger, and an index finger are to be inserted; and a thumb sheath, wherein, after the four-finger body is joined with the thumb sheath, a five-finger body is formed such that a palm-side fabric-segment of the five-finger body has a less number of stitches than a backhand-side fabric-segment of the five-finger body, whereby the thumb sheath protrudes outward from the palm-side fabric-segment of the five-finger body and is disposed in a rotating manner with respect to the palm-side fabric-segment.

11. The method for knitting the glove according to claim 2, wherein, before joining the four-finger body with the thumb sheath, the four-finger body is knitted in a manner such that a knitting width of the four-finger body is increased by increasing stitches at a section of the four-finger body proximate the thumb sheath.

12. The method for knitting the glove according to claim 3, wherein, before joining the four-finger body with the thumb sheath, the four-finger body is knitted in a manner such that a knitting width of the four-finger body is increased by increasing stitches at a section of the four-finger body proximate the thumb sheath.

* * * * *